US005592778A

United States Patent [19]

McGuire

[11] Patent Number: 5,592,778

[45] Date of Patent: Jan. 14, 1997

[54] SAFETY TURNSTILE

[75] Inventor: John D. McGuire, Brampton, Canada

[73] Assignee: Brascon Architectural Products Inc.

[21] Appl. No.: 344,000

[22] Filed: Nov. 17, 1994

[51] Int. Cl.[6] ..... E05D 15/02

[52] U.S. Cl. ..... 49/42; 49/141; 49/506

[58] Field of Search ..... 49/42, 46, 47, 49/141, 506

[56] References Cited

U.S. PATENT DOCUMENTS

| | | | |
|---|---|---|---|
| 2,037,397 | 4/1936 | Stevens | 49/42 |
| 3,978,613 | 9/1976 | Hayward et al. | 49/46 |
| 5,072,543 | 12/1991 | Tetherton | 49/47 |

FOREIGN PATENT DOCUMENTS

| | | | |
|---|---|---|---|
| 195305 | 3/1923 | United Kingdom | 49/42 |

*Primary Examiner*—Philip C. Kannan
*Attorney, Agent, or Firm*—Eugene J. A. Gierczak

[57] ABSTRACT

A turnstile is disclosed which is easily adapted to operate in either a clockwise or counterclockwise direction of rotation and which does not permit reverse rotation during operation. Resistance to rotation in the reverse direction is achieved by means of a drag shoe mechanism. As a rotor mechanism rotates about a corresponding stator mechanism it trails a drag shoe by a rigid connecting rod, or drag arm, across a bearing surface. The drag arm is disposed at a non-perpendicular angle. In reverse motion the angularly inclined drag arm forces the drag shoe to jam into the bearing surface and thereby act as a brake. The turnstile is provided with a quick release wrench, an safety release bolt which protrudes beyond the housing of the turnstile mechanism, and emergency release instructions labels clearly visible on the top and pillar of the turnstile. Should a child, or other person, become trapped in the turnstile one may easily and quickly release the turnstile by inserting the wrench in the safety release bolt and loosening the mechanism. When loosened the mechanism, and hence the turnstile, swings freely in either direction.

15 Claims, 8 Drawing Sheets

SAFETY TURNSTILE

FIELD OF INVENTION

This invention relates to the mechanism of a turnstile. In particular it concerns a smoothly turning continuous motion turnstile, suitable for either clockwise or counter-clockwise unidirectional rotation, resistant to freewheel spinning and capable of being easily disengaged in an emergency to permit reverse motion.

BACKGROUND ART

Turnstiles have long been known. Commonly they involve a gate which rotates only in one direction about an axis, operating in co-operation with an adjacent barrier. They permit passage of persons or animals in one direction only. Turnstiles are known with internal gearing, coin or ticket operation, mechanical detents, and the like.

Children often enjoy playing with turnstiles. In some instances children try to spin the turnstile as quickly as they can, and may injure themselves with or in the rotating structure. In particular, children may be prone to climb upon, and trap themselves between, the rotating pans of the turnstile and an adjacent barrier. The turnstile can only turn in one direction, so it can only become more tightly jammed as a child struggles.

Presently known turnstiles may be released by use of electric solenoids to disengage an internal gear mechanism, or by swinging the entire turnstile out of the way.

One type of common turnstile employs a solid machined block fit into the top of a hollow support column. The machined block is adapted to seat a pair of one way roller or needle bearings such that the rotating member can only turn in one direction. This embodiment has several disadvantages. First, the turnstile cannot be adapted to turn in the opposite direction without major disassembly to permit the block and bearings to be installed in the opposite direction. Second, the bearings may be inadequately suited to eccentric loads applied, for example, when adults place extreme force on the arms of the turnstile. Third there is no emergency release. If a child is jammed in the bars it may be necessary to unbolt the entire assembly from the floor. Fourth, the block is held in the shaft by a single screw. Over time the block may begin to shift back and forth in the shaft, rotating about the axis of the screw.

As turnstiles are often used by children as toys they are often subject to abuse. Thus them is a need for a safety turnstile which may be easily released, may turn in either direction, will resist high speed spinning, and which is sufficiently rugged to survive moderately abusive treatment.

Further examples of prior an for turnstiles include U.S. Pat. No. 5,072,543 which relates to a turnstile made with a stationary turnstile support shaft extending from a solid support, and a bearing on the end of the shaft. The turnstile hub is supported on the end of the shaft with a bearing. The turnstile hub is locked against rotation in a fee-paid direction by a unidirectional pawl that engages a cutout on a ratchet plate attached to the hub. The unidirectional pawl is released by energizing a solenoid latching mechanism.

In addition, U.S. Pat. No. 3,978,613 relates to a turnstile mechanism comprising a rotatable hub adapted to be driven by a person using a turnstile, the hub being connected to (or incorporating) a disc formed with a number of stop surfaces which are engageable by a stop member which is movable between a first position clear of the path of the stop surfaces and a second position lying in the path of the stop surfaces.

Further, U.S. Pat. No. 3,914,902 relates to a turnstile which includes a turnstile head pivotally mounted on a support for rotation about an axis defined by the support. A shaft is journaled in the turnstile head and a hub is keyed to the shaft for the rotation thereof responsive to the rotation of the hub. Arms carried by the hub radiate therefrom in a conical formation, and when indexed in the home position, one of the arms is disposed in a substantially horizontal passage barring position while the remaining arms are disposed in a substantially vertical position. A spur gear is keyed to the shaft at the end thereof opposite the end portion to which the hub is keyed and is in meshed relationship with a pinion gear which is journaled in the turnstile head and which is provided with a roller clutch which allows for rotation of the pinion gear in a single direction only. Three depending roller cams are disposed about the periphery of the spur gear which is aligned on the shaft so that the roller cams are substantially radially aligned with the extending arms carried by the hub.

U.S. Pat. No. 3,383,797 relates to a turnstile utilizing a cam controlled assembly.

SUMMARY OF THE INVENTION

The present invention provides a safety turnstile suitable for either clockwise or counter-clockwise rotation, which is resistant to freewheel spinning, and which may be released easily. In one aspect of the invention described herein a turnstile is provided which comprises a stator assembly; a rotor assembly coaxially mounted about the stator assembly for pivotal motion about the stator assembly; adjustment means to position the rotor assembly relative to the stator assembly normally to the pivotal motion, the stator assembly comprising one of: (a) a bearing surface or (b) at least one drag shoe assembly, the rotor assembly comprising the other of: (a) at least one drag shoe assembly or (b) a bearing surface, the adjustment means adapted to be adjusted from a first position in which the drag shoe assembly is disengaged from the bearing surface to a second position in which the drag shoe assembly rests against and angularly engages the bearing surface, whereby in the second position pivotal motion of the rotor assembly in a first direction of rotation with respect to the stator assembly is accompanied by sliding engagement of the at least one drag shoe assembly with the bearing surface and pivotal motion of the rotor assembly in a second, opposite, direction of rotation with respect to the stator assembly is accompanied by jamming of the drag shoe assembly against the bearing surface.

In a further aspect of the invention the turnstile comprises a quick release mechanism wherein the quick release mechanism comprises a quick release wrench and a gripping means, such as a threaded bolt of the turnstile adjustment means having a through hole, whereby a cylindrical shaft of the quick release wrench is introduced through the through hole to facilitate loosening of the threaded bolt.

DETAILED DESCRIPTION OF THE BEST MODE FOR CARRYING OUT THE INVENTION

Figure 1:
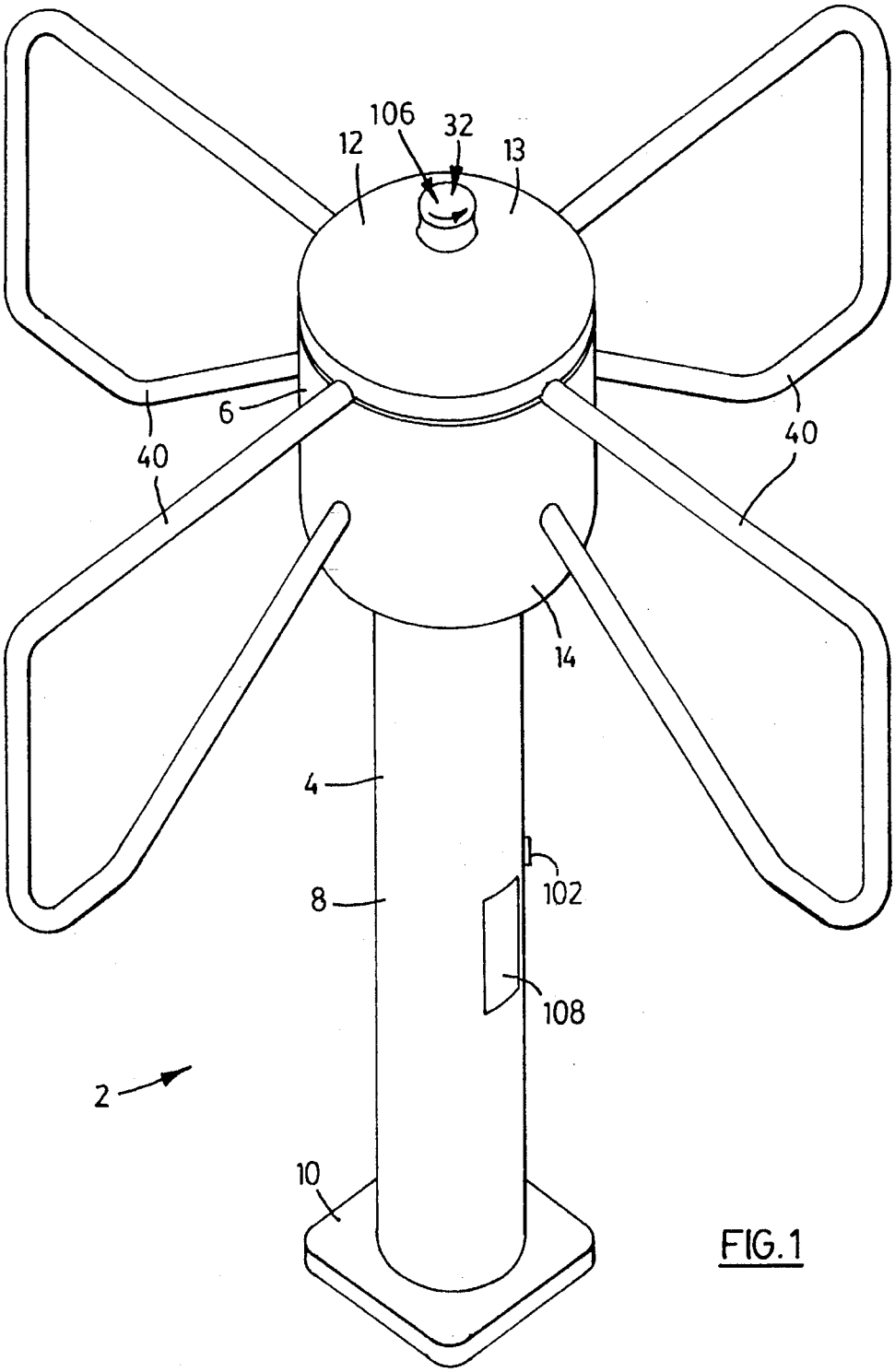
FIG. 1 is a perspective general view of a turnstile according to the present invention.

As shown in FIG. 1, a turnstile assembly is shown generally as 2. It comprises a stator assembly 4, which is by definition stationary, and a rotor assembly 6 mounted coaxially with, and for pivotal motion, or rotation, about, the stator assembly 4. Also shown in FIG. 1 are a pillar 8, floor mounting means 10, and a turnstile housing 12 comprising an upper shell 13, and a lower shell 14.

Figure 2:
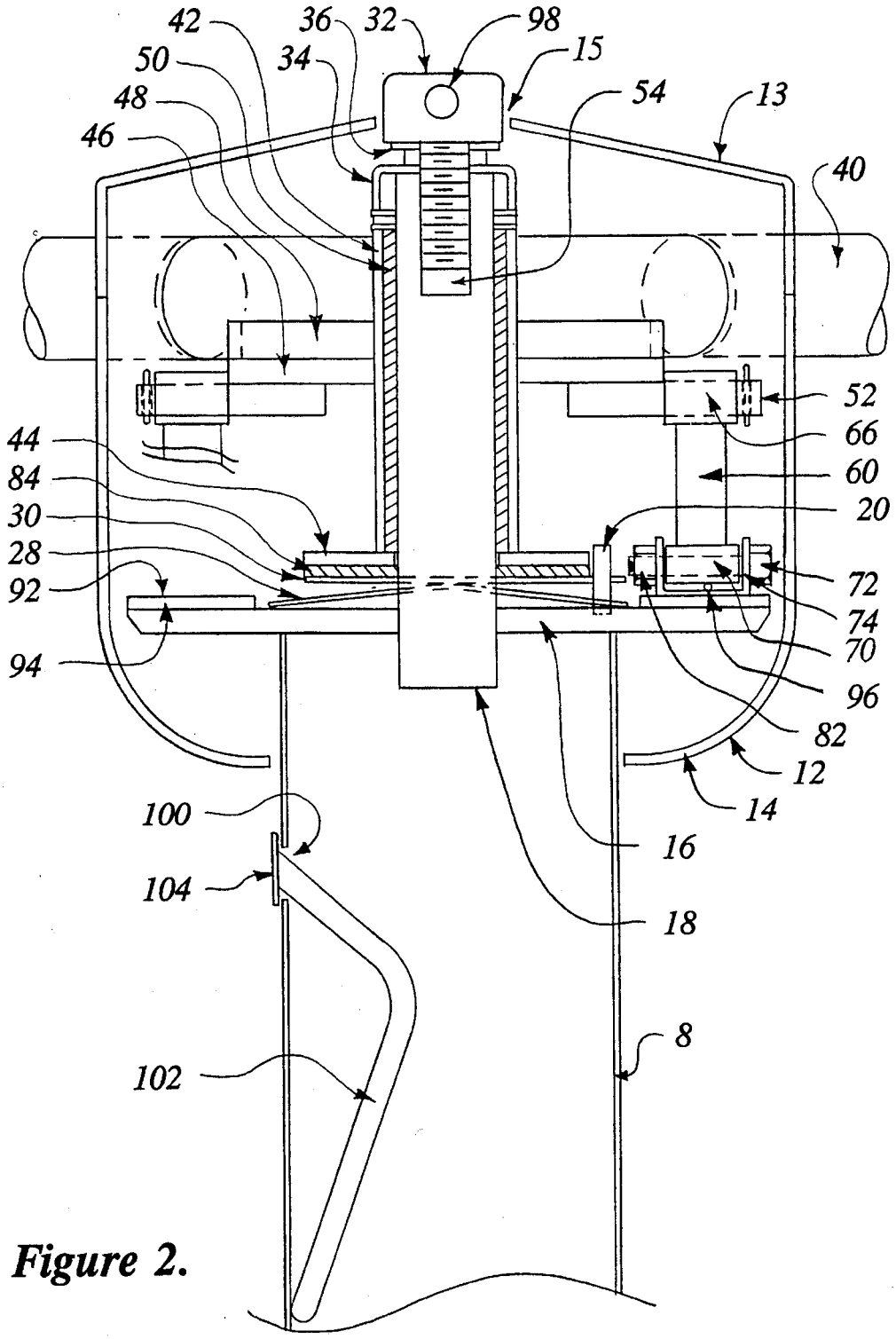
FIG. 2 is a cross-sectional view of the turnstile of FIG. 1.
Figure 2A:
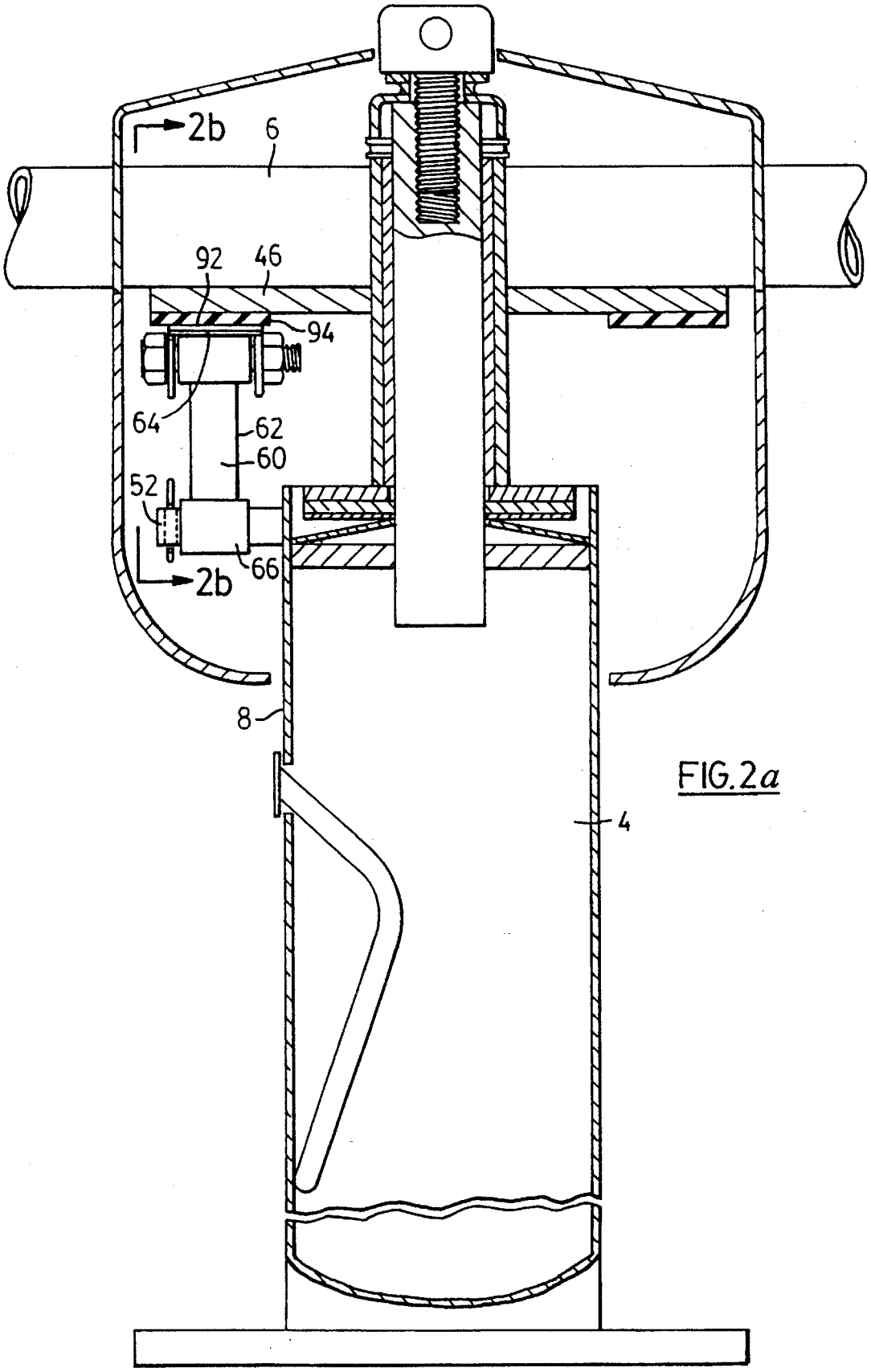
FIG. 2*a* is a cross-sectional view of the second embodiment.
Figure 2B:
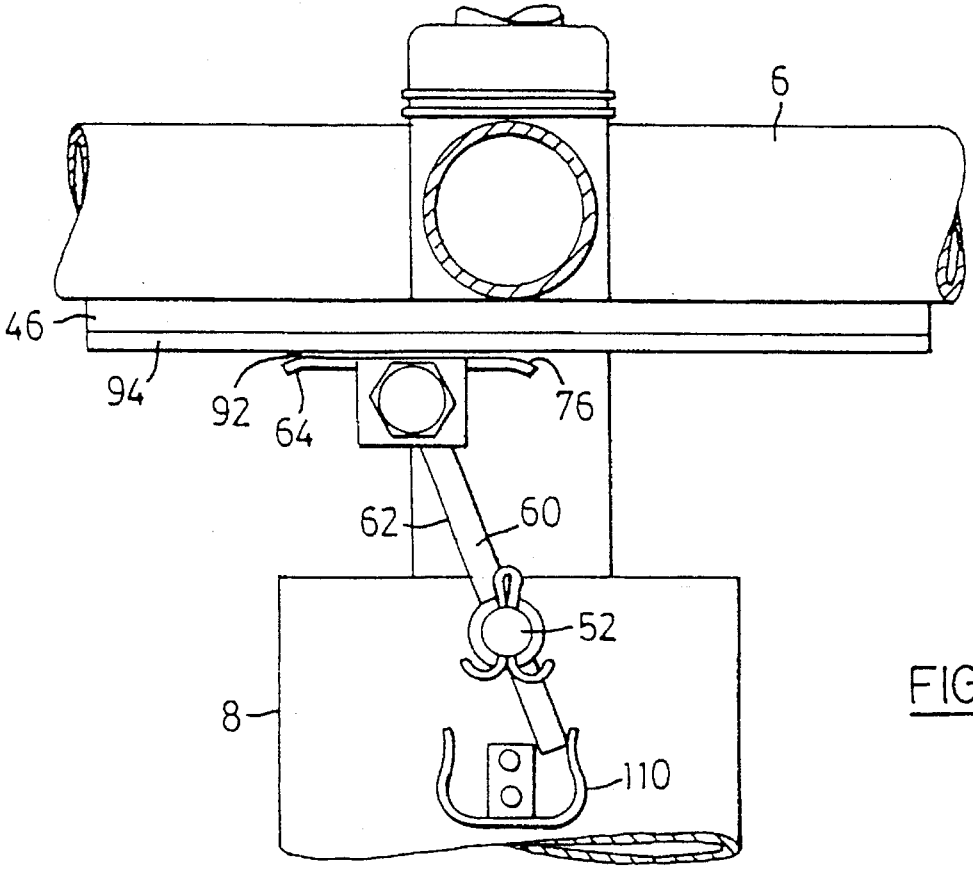
FIG. 2*b* is a side view of the second embodiment.

As shown in FIG. 2, the stator assembly 4 comprises pillar 8, floor mounting means 10, a main shaft base plate 16, a main shaft 18, a pin 20, a flat spring 28 and a lower friction plate 30. The upper part of the stator assembly 4 further comprises a safety top bolt 32, and a cap washer 34 to which a reinforcing flat washer 36 has been welded. This reinforced cap washer may be replaced by a solid machined fitting or other equivalent such as would be known to those skilled in the art.

The rotor assembly 6 comprises, in addition to housing 12, arms shown generally as 40, a main rotor tube 42, a rotor bottom washer 44, a rotor intermediate plate 46, arm retainers 48, a machined Ultra High Molecular Weight Polyethylene, or UHMW, rotor bushing 50, and at least one rotor drag pin 52. Those skilled in the art will appreciate that materials other than UHMW may be used for rotor bushing 50.

In the preferred embodiment shown herein rotor assembly 6 further comprises at least one drag shoe assembly, shown generally as 60, itself comprising a drag arm 62 and a drag foot 64. Other embodiments of the invention disclosed herein are possible in which stator assembly 4 comprises drag shoe assembly 60 or a functional equivalent thereof.

The pillar 8 is mounted to a suitable floor by the floor mounting means 10 rigidly affixed at its lower end. The floor mounting means 10 may be welded to the pillar 8 or fastened thereto by rivets, threaded fasteners or other known structural attachment methods. The floor mounting means may be adapted, for example, to accept threaded studs embedded in the floor. Many such means are known.

As shown in FIG. 2, the main shaft base plate 16 is attached to the upper end of pillar 8 by means such as welding, and rests substantially parallel to the chosen floor surface. Located centrally in, and extending upwardly from, base plate 16 is the cylindrical main shaft 18, which is substantially co-axial with the longitudinal axis of pillar 8. Again, welding is the preferred fastening means although many other means are known. The flat spring 28 is substantially square with clipped comers and has a generally centrally located aperture (not shown) which permits it to slide over the main shaft 18 and to rest with two opposite peripheral edges in contact with base plate 16. The lower friction plate 30 is also provided with a central aperture (not shown) to permit it to slide down over the main shaft for installation in contact with the upper face of the flat spring 28. To prevent the lower friction plate 30 turning about main shaft 18 the pin 20 is recessed into base plate 16 and extends upwardly therefrom to traverse-and engage an indexing clearance hole (not indicated) in lower friction plate 30.

The uppermost end of main shaft 18 has a blind drilled and tapped hole 54 adapted to engage the threaded shaft of the safety top bolt 32. The lower face of the head of safety top bolt 32 bears upon the upper surface of flat washer 36, welded, as noted, to cap washer 34. A lock washer, not shown, may be inserted between safety top bolt 32 and flat washer 36. As will be described in greater detail below, when the turnstile 2 is assembled the rotor assembly 6 is captured between the lower face of cap washer 34 and the upper surface of the lower friction plate 30.

In rotor assembly 6 the rotor bottom washer 44 is fixedly attached centrally about the longitudinal axis of, and perpendicularly to, the main rotor tube 42. The rotor intermediate plate 46 is fixedly located about, and co-axial with, the main rotor tube 42 and is substantially parallel to the rotor bottom washer 44. The length of main rotor tube 42 is chosen to accommodate the height of the drag shoe assembly 60 when disengaged, as will be described below, and to accommodate the arms 40. The main shaft 18 is chosen to have a correspondingly suitable length. Finally, the length of main rotor tube 42 is such that the assembly will resist wear when eccentric loads are applied i.e., the bending moment applied when a child swings on the end of an arm. In the preferred embodiment rotor intermediate plate 46 has been located to permit all of arms 40 to rest shy of the uppermost end of main rotor tube 42 when installed.

Figure 5:
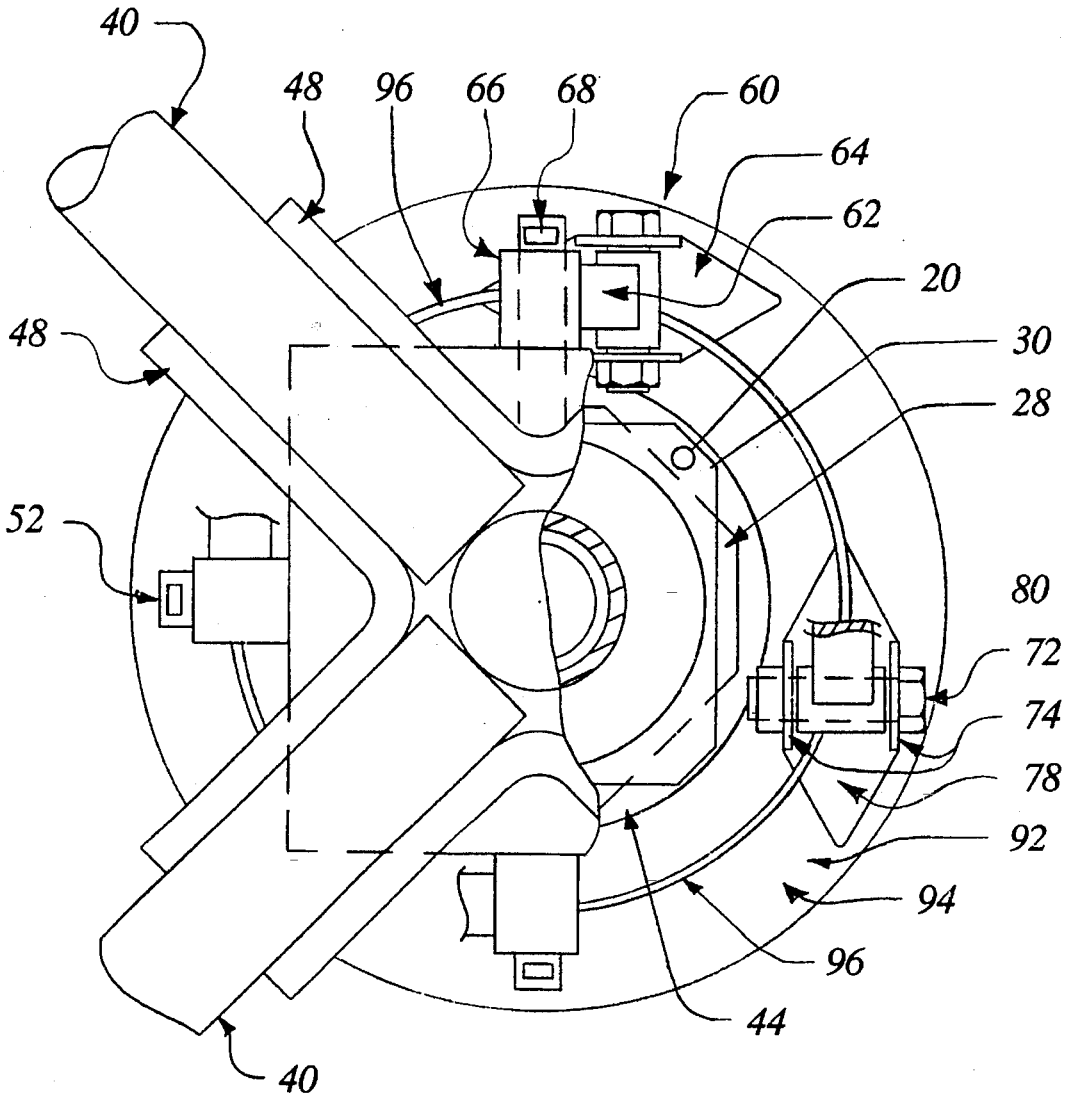
FIG. 5 is a partially sectioned plan view of the internal assembly of the turnstile of FIGS. 1, 2, and 4.

As best shown in FIG. 5, arm retainers 48 are made by forming strips of metal into right angled bends, and then welding them to the upper surface of rotor intermediate plate 46 radially about the longitudinal axis of the rotor assembly on 90 degree arc intervals such that the arms of two adjacent arm retainers 48 are substantially parallel and spaced apart a suitable distance to accommodate the width of, and thereby act as stop for, the arm 40. There are many alternative means for achieving the retention of arms 40 such as would be well known to those skilled in the art. In the preferred embodiment each of the four arms 40 is welded to the arm retainers 48.

Drag pin 52 is aligned radially from the longitudinal axis of rotor assembly 6 and is fixedly attached to rotor intermediate plate 46. In the preferred embodiment each drag pin 52 is ⅜ inches in diameter and is located in each of four locations at 90 degree arc intervals.

Rotor bushing 50 is machined from UHMW material to fit within main rotor tube 42 and to mate slidably with main shaft 18.

Figure 3:
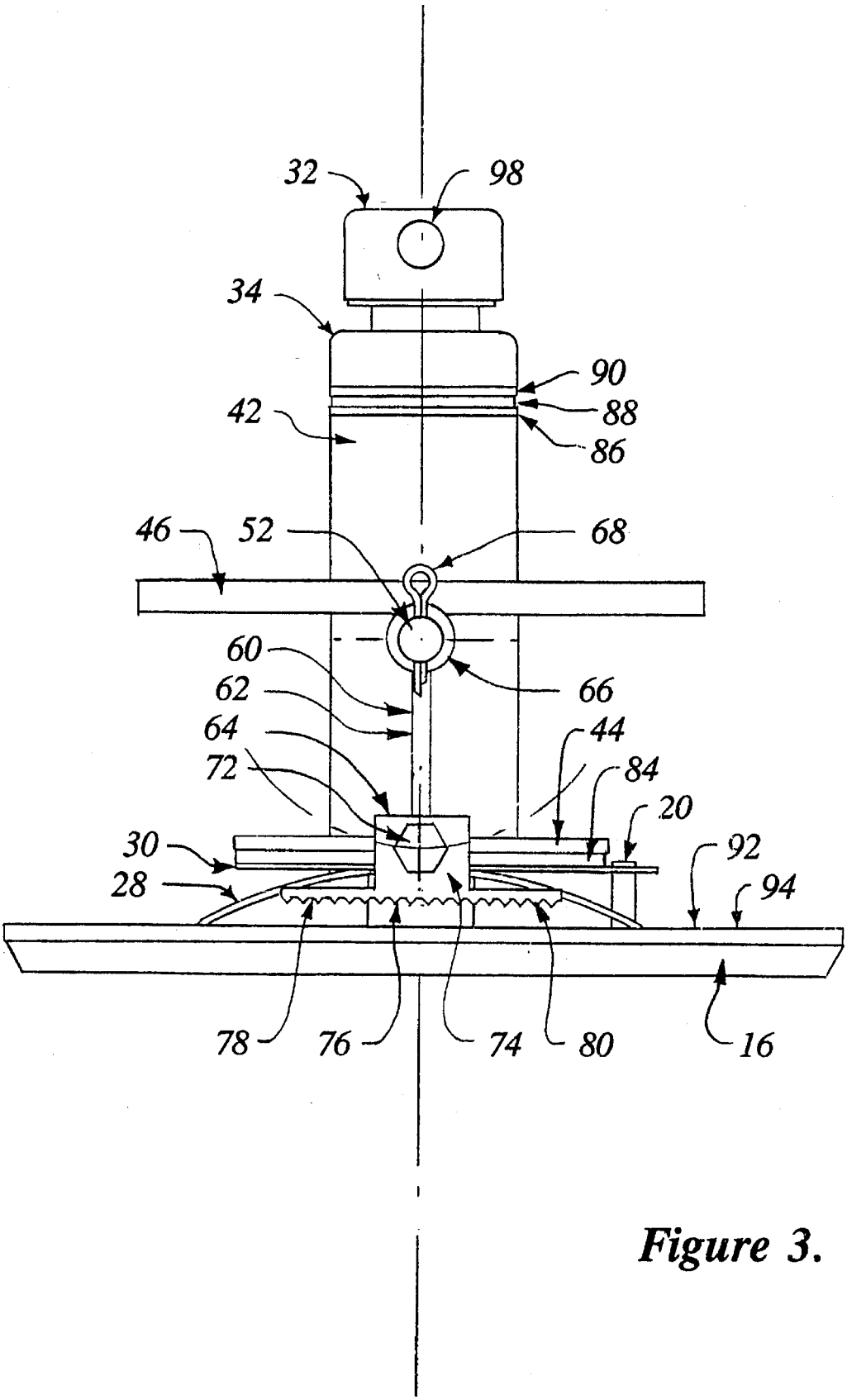
FIG. 3 is a perpendicular view of the internal assembly of FIG. 2 showing a drag shoe assembly of the present invention in a disengaged position.
Figure 4:
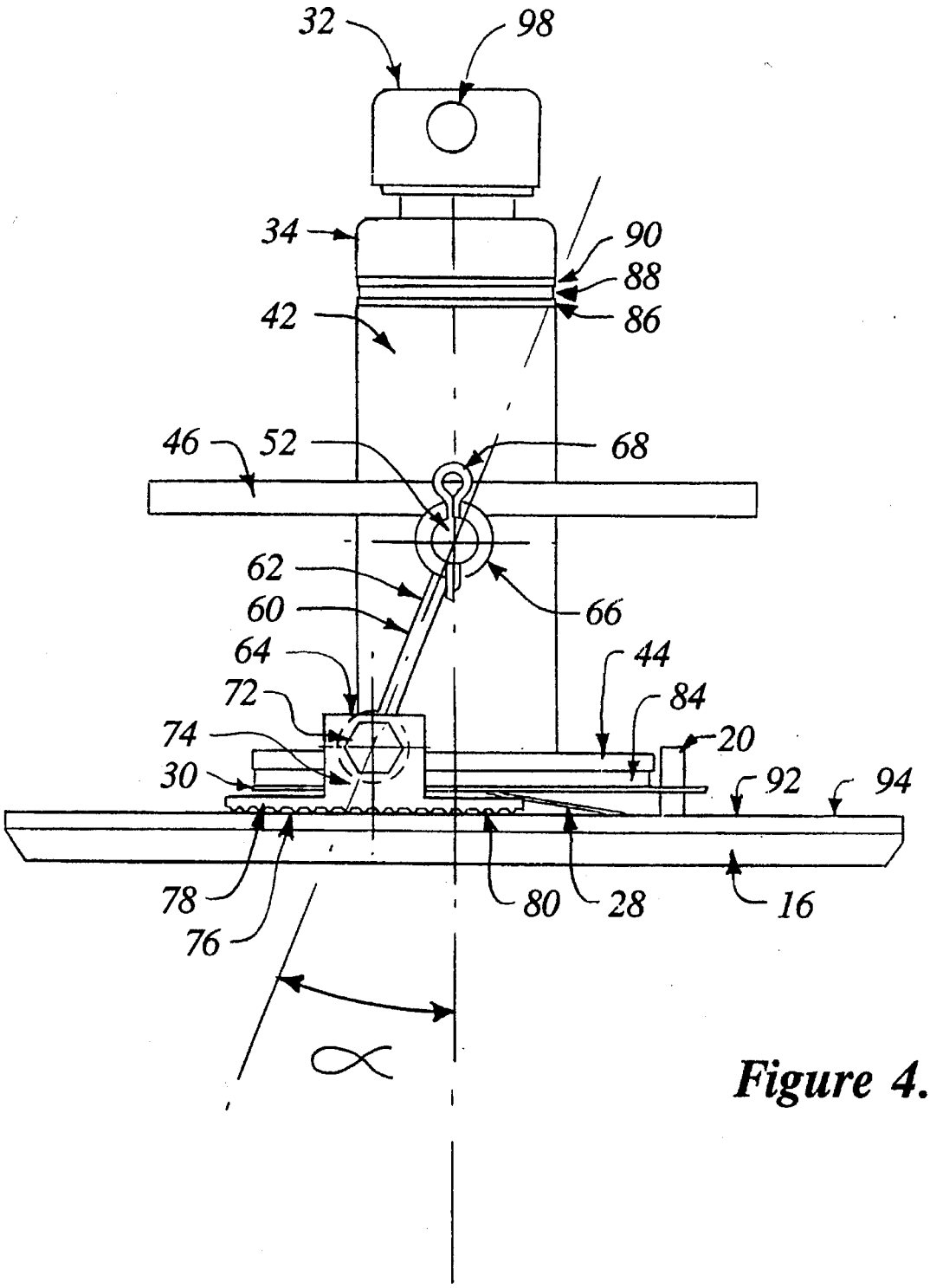
FIG. 4 shows the drag shoe assembly of FIG. 3 in a position in which it is engaged to permit clockwise rotation of the turnstile.

Drag Shoe assembly 60 is best shown in FIGS. 3 and 4. At one extremity drag arm 62 comprises a first cylindrical boss 66 suitable for slidable location on and pivotal motion about drag pin 52. Drag arm 62 may be retained on drag pin 52 by many well known means. In the preferred embodiment a cotter pin 68 is shown, with flat washers (not indicated) on either side of the boss to reduce wear. At the other extremity drag arm 62 comprises a second cylindrical boss 70 suitable for slidable admission of, and pivotal rotation about a shaft, or shank, of a retaining bolt 72.

Drag foot 64 comprises two substantially parallel upturned tabs, or ears 74, and a sole 76 having a roughened bearing surface, much like the tread on the sole of a shoe. In the preferred embodiment an array of cold formed serrations has been impressed on the sole 76, although many other means for achieving the same result have been long known. Drag foot 64 also comprises a first toe 78 and an opposed second toe 80. Each of the ears 74 has an aperture located such that bolt 72 may be introduced through one ear, through boss 70, and through the other ear, like a trunnion in a clevis, thus creating a pivotal attachment of drag foot 64 to drag arm 62. Bolt 72 is then secured by a locknut 82. In the preferred embodiment this is a nylon insert locknut.

To assemble turnstile 2, one begins with the stator assembly 4, with the safety top bolt 32 and cap washer 34 removed. To prevent wear and to provide normal operational drag between the rotor assembly 4 and the stator assembly 6, an UHMW friction washer 84 is installed about the main shaft 18 with its lower face in contact with the lower friction plate 30. The rotor assembly 6 including such number of drag shoe assemblies as may be chosen, slides down over main shaft 18 to rest with the rotor bottom washer in contact with the upper face of UHMW friction washer 84. Similarly, to prevent wear at the upper end of main rotor tube 42, a first flat washer 86 is located about main shaft 18 abutting main rotor tube 42. A flat thrust bearing 88 and a subsequent second flat washer 90 are stacked on top of first flat washer 86. Cap washer 34 is installed such that the lower edge of its skirt bears downward on second flat washer 90. Safety top bolt 32 is then threadably engaged in tapped hole 54. This position, prior to tightening of safety top bolt 32 corresponds to the disengaged position shown in FIG. 3.

As can be seen in FIG. 2, tightening of safety top bolt 32 will cause compression of flat spring 28, as the load imposed by safety top bolt 32 is carried through cap washer 34, second flat washer 90, thrust bearing 88, first flat washer 86, main rotor tube 42, rotor bottom washer 44, UHMW friction washer 84, and lower friction plate 30.

The limit of this tightening will occur when the inner side of cap washer 34 bottoms on the top of main shaft 18. In this fully tightened or lock-down position the rotor assembly is forced against first flat washer 86 by the spring preload of flat spring 28. In the preferred embodiment this fully tightened pre-load is roughly 65 Lb. Clearly one may vary the spring to obtain a different pre-load.

As safety top bolt 32 is tightened the normal force transmitted across UHMW friction washer 84 increases, causing a corresponding increase in friction. Turnstile 2 will continue to turn smoothly, but more stiffly. It may thereby resist rapid spinning by children.

As shown in FIG. 3, as safety top bolt 32 first begins to engage tapped hole 54 each drag shoe assembly 60 will hang with its drag arm 64 in a substantially vertical orientation from its corresponding rotor drag pin 52. This may be considered as a first, or disengaged position. As such the rotor may be turned easily either clockwise or counter-clockwise.

As safety top bolt 32 is tightened the roughened sole 76 will come into contact with base plate 16. Base plate 16 comprises a bearing surface 92 for this purpose. In the preferred embodiment base plate 16 comprises a bonded, abrasion resistant rubber drag ring 94 co-axial with the main shaft 18. The rubber drag ring 94 is sized to correspond to the path traced out by each drag shoe assembly 60 during pivotal motion of the rotor assembly about the stator assembly, and bearing surface 92 is the upper surface of drag ring 94. The inner circumference of drag ring 94 is great enough to permit flat spring 28 to seat therewithin. Many alternative material combinations would achieve a similar effect.

If each drag arm 62 is permitted to remain in a vertical orientation while the safety top bolt is tightened the device will not work since further tightening will only jam each drag shoe assembly into the bearing surface 92. Thus, as tightening occurs the rotor assembly 6 must be gently turned about the stator assembly 4 in the direction one wishes the turnstile to operate. This turning will also ensure that all drag assemblies lean the same way for the purposes of rotation. If the turnstile is given a sudden jarring impact the shoes may become disoriented relative to, or flip up from, the bearing surface. A ring shaped retaining spring, 96 is threaded through each drag foot to prevent this. It acts as a spider and thereby each shoe is limited to a modest angular displacement.

In use the drag shoe assembly 60 of the preferred embodiment will be oriented in a second, locked-down, or engaged, position substantially similar to that shown in FIG. 4 for counter-clockwise rotation. As can be seen, tightening of safety top bolt 32 has reduced the perpendicular distance between rotor intermediate plate 46 and base plate 16 such that drag arm 62 is compelled to lie at some acute angle from the vertical, and not perpendicular to base plate 16. This angle is designated in FIG. 4 by the Greek letter alpha. For clockwise rotation angle alpha would be reversed, that is, it would lie on the other side of the perpendicular centerline of the preferred embodiment. For the purposes of this specification alpha is the engagement angle of the drag shoe assembly. In the fully tightened pre-load position, or locked-down angle, of the preferred embodiment of FIG. 4 alpha is roughly 22 degrees.

When rotor assembly 6 is turned in the desired direction of rotation each drag foot slides easily on bearing surface 92. However, rotation in the opposite direction causes one or more roughened sole 76 to impart a compressive component of force into the drag arm, and a tangential component of force to rotate the drag arm to cause angle alpha to decrease. As a result at least one drag shoe assembly becomes jammed, preventing further rotation. There is little backlash in the assembly because the preload in the flat spring keeps the rotor assembly snug against flat washer 86 during normal operation. Thus the tendency to force the rotor assembly 6 upward on the main shaft 18 in reverse motion is limited because the rotor assembly 6 is already against its upper vertical stop, flat washer 86. The jammed condition may be released either by resuming rotation in the first direction, or by releasing the safety top bolt 32.

Angle alpha increases as safety top bolt 32 is tightened toward the lock-down position. Thus the tightening of safety top bolt 32 provides an adjustment, or displacement means adapted to adjust, or displace, each drag shoe assembly 60 from the first spaced position in which the drag shoe assembly 60 is disengaged or spaced from bearing surface 92 as shown in FIG. 3, to a second position in which the drag shoe assembly 60 rests against and angularly engages bearing surface 92 as shown, typically, in FIGS. 4 and 5. In the second, angularly engaged position pivotal motion of the rotor assembly 6 in the chosen turning direction with respect to the stator assembly 4 is accompanied by sliding engagement or dragging of at least one drag shoe assembly 60 relative to bearing surface 92. Pivotal motion of the rotor assembly 6 in the opposite direction of rotation with respect to the stator assembly 4 is accompanied by jamming of the drag shoe assembly 60 relative to bearing surface 92. It will be noted that the invention described herein will operate at least temporarily at angles less than the fully engaged, or lock-down angle of the preferred embodiment in which cap washer 34 bottoms against main shaft 18. One may also increase the lock down angle by locating additional flat washers between cap washer 34 and second flat washer 90.

This increases the compression of flat spring 28, and therefore the drag across UHMW washer 30.

It will be recognized by those skilled in the art that the principles of the present invention may be applied over a range of values for angle alpha. The range has two limits. First, angle alpha must not be so great that drag shoe assembly 60 merely skids along bearing surface 92 when the rotor assembly 6 is turned in the reverse direction (whichever that direction may be in the circumstances). For the purpose of this specification the angular threshold of this skidding condition is called the slip angle.

Similarly, alpha must be small enough that drag shoe 60 jams in reverse motion. This limit will vary with the combination of materials chosen for sole 76 and bearing surface 92, for example. As alpha approaches zero the resultant perpendicular force applied in reverse motion may be sufficient to compress, and displace, bearing surface 92 far enough to permit drag arm 62 to swing past the perpendicular, instead of jamming. For the purposes of this specification this is called the back-over angle. The angular threshold of this 'back-over' condition will again depend on the materials chosen for the drag shoe assembly 60, bearing surface 92, the tolerances between the various elements of drag shoe assembly 60, and the force applied to any of arms 40. The forces generated in the jamming condition may be large enough to deform cap washer 34. Cap washer 34 is therefore reinforced by welded flat washer 36. Other reinforcement means are well known. In normal operation a force of 20 to 40 Lb. will not cause the turnstile of the preferred embodiment to reverse. However, it may be desirable for the application of a large force by an adult such as, in the case of the preferred embodiment, a force in the order of 80 or 100 Lb or more, to cause a back over condition in preference to permanent deformation of the internal elements of the turnstile. This emergency backover also provides a secondary emergency release function. As previously stated, the actual force required to cause a backover is dependent upon the materials chosen, the lock-down angle chosen, the tolerances during manufacture and the accumulated length of time in service.

It should also be noted that bearing surface 92 need not necessarily be flat. It is possible to practice the principles of the present invention on a frusto-conical bearing surface, or even a bearing surface that has a round, channel, v-shaped or other profile. Similarly, the drag arm need not pivot about drag pin 52 in a precisely vertical plane, but may be suspended at some angle such that pivotal motion of drag arm 62 about drag pin 52 has a radial component toward or away from main shaft 18. In all cases the limitation on the chosen geometry is that it must be such as to cause the drag shoe assembly 60 to jam into the bearing surface in reversed motion, and that gravity, or a biasing device, which may be a spring, cause the drag shoe assembly 60 to ride upon the bearing surface during rotation in the forward direction, whichever direction may be chosen.

Once the rotor assembly has been captured by safety top bolt 32, the upper shell 13 and lower shell 14 are located, for example with threaded fasteners, to form housing 12. Upper shell 13 has a central aperture 15 to permit a substantial portion of the head of safety top bolt 32 to protrude beyond housing 12 as shown in FIGS. 1 and 2. In the preferred embodiment, safety top bolt 32 is thereby made externally accessible.

Figure 6:
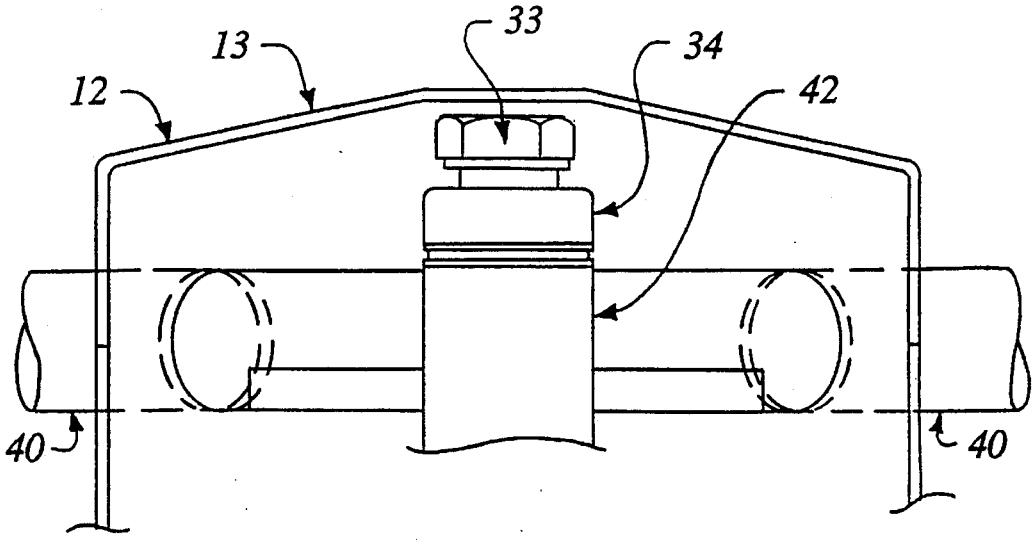
FIG. 6 shows a second embodiment of the turnstile of FIG. 2.

A second embodiment illustrated in FIG. 6 includes an upper shell 13 which lacks aperture 15. In this case the upper shell must first be removed before an alternate top bolt 33 may be released, alternate top bolt 33 having a standard hexagonal head suitable for standard wrenches.

In the preferred embodiment top bolt 32 may be grasped and adjusted by hand. For those who may not have a sufficient grip to release top bolt 32 by hand, top bolt 32 has been provided with a through hole 98. Pillar 8 comprises an aperture 100 to admit for storage a quick release wrench 102 having a bent cylindrical shaft (not separately indicated) and a head 104. Aperture 100 permits entry of the bent shaft, but not the quick release wrench head 104. When it is desired to release top bolt 32 quick release wrench 102 is taken from its storage position and its shaft is introduced through hole 98. Through hole 98 provides a gripping means adapted to be engaged by quick release wrench 102. Wrench 102 may then be turned to loosen top bolt 32. A first release instruction label 106 is affixed to the head of top bolt 32 to indicate release by counter-clockwise rotation. Similarly, a second release instruction label 108 is affixed to pillar 8 near to aperture 100 to provide emergency release, and readjustment instructions.

In an emergency one may wish to use the first tool which comes to hand. Therefore, through hole 98 is of a chosen diameter such that it will admit not only quick release wrench 102, but also any size of phillips or robertson screwdriver, small slot headed screwdrivers or other pointed objects.

Thus a turnstile of the preferred embodiment does not incorporate complicated gear, cam, or detent systems, provides smooth operation in either direction as chosen, and may be easily released if jammed.

It will be obvious to those skilled in the art that there are other possible embodiments in which the drag shoe assembly may be mounted to a stator element and the bearing surface may be part or a rotor unit without departing from the principles of the invention disclosed herein. Similarly, although the preferred embodiment incorporates four drag shoe assemblies, it is possible to practice the principles of the invention with as few as one drag shoe, or as many more than four drag shoes as desired.

I claim:

1. A turnstile comprising:

a stator assembly;

a rotor assembly coaxially mounted for rotation about said stator assembly;

said stator assembly including one of: (a) a bearing surface or (b) at least one drag shoe assembly;

said rotor assembly including the other of: (a) at least one drag shoe assembly or (b) a bearing surface;

displaceable means adapted to be moved from a first position in which said drag shoe assembly is disengaged from said bearing surface to a second position wherein said drag shoe assembly rests against and angularly engages said bearing surface whereby in said second position pivotal motion of said rotor assembly in a first direction of rotation with respect to said stator assembly is accompanied by sliding engagement of said at least one drag shoe assembly with said bearing surface and pivotal motion of said rotor assembly in a second, opposite, direction of rotation with respect to said stator assembly is accompanied by jamming of said drag shoe assembly with said bearing surface.

2. The turnstile of claim 1 in which said rotor assembly comprises said bearing surface and said stator assembly comprises said at least one drag shoe assembly;

said stator assembly comprises at least one drag pin;

said drag shoe assembly comprises a drag arm and a drag foot;

said drag arm pivotally mounted to said drag pin and said drag foot pivotally mounted to said drag arm.

3. A turnstile comprising:

a stator assembly;

a rotor assembly coaxially mounted for rotation about said stator assembly;

said stator assembly includes a bearing surface;

said rotor assembly includes at least one drag shoe assembly; displaceable means adapted to be moved from a first position in which said drag shoe assembly is disengaged from said bearing surface to a second position wherein said drag shoe assembly rests against and angularly engages said bearing surface;

whereby in said second position pivotal motion of said rotor assembly in a first direction of rotation with respect to said stator assembly is accompanied by sliding engagement of said at least one drag shoe assembly with said bearing surface and pivotal motion of said rotor assembly in a second, opposite, direction of rotation with respect to said stator assembly is accompanied by jamming of said drag shoe assembly with said bearing surface; said rotor assembly comprises at least one drag pin; said drag shoe assembly comprises a drag arm and a drag foot; said drag arm pivotally mounted to said drag pin and said drag foot pivotally mounted to said drag arm.

4. The turnstile of claim 3 wherein:

in said second position said drag shoe assembly is disposed to engage said bearing surface at an angle;

said angle falling within a range of angles between a first, back over, angle and a second, slip, angle.

5. The turnstile of claim 4 wherein:

said drag foot has a metallic roughened sole, said bearing surface is rubber and said angle is in the range 15 to 30 degrees.

6. The turnstile of claim 3 in which:

in said second position said drag shoe assembly rests against and angularly engages said bearing surface due to gravity.

7. The turnstile of claim 3 in which:

said displacement means is for positioning said rotor assembly relative to said stator assembly normally to said pivotal motion.

8. The turnstile of claim 3 wherein said turnstile comprises a quick release mechanism.

9. The turnstile of claim 8 wherein said quick release mechanism is externally accessible.

10. The turnstile of claim 8 wherein said quick release means comprises a quick release wrench and a gripping means adapted to be engaged by said wrench.

11. The turnstile of claim 10 wherein said displacement means comprises:

a threaded bolt working in opposition to a spring;

said threaded bolt comprises a head, said head being provided with a through hole formed therein;

said gripping means is said through hole; and said wrench comprises a cylindrical shaft adapted for entry through and engagement of said through hole of said threaded bolt.

12. For a turnstile comprising a stator assembly; a rotor assembly coaxially mounted about said stator assembly for pivotal motion about said stator assembly; said turnstile comprising displacement means to position said rotor assembly relative to said stator normally to said pivotal motion; said stator assembly comprising one of a bearing surface or at least one drag shoe assembly; said rotor assembly comprising the other of said at least one drag shoe assembly or said bearing surface and said displacement means adapted to adjust said turnstile from a first disengaged position to a second engaged position; a method of reversing the direction of operation of said turnstile; said method comprising:

manipulating said displacement means to said first, disengaged position;

turning said rotor assembly about said stator assembly in the desired direction of rotation; and while continuing said turning, tightening said displacement means until said drag shoe assembly rests against and angularly engages said bearing surface.

13. A turnstile suitable for one way rotation in a chosen direction of rotation comprising:

a stator assembly; a rotor assembly coaxially mounted about said stator assembly for pivotal motion about said stator assembly;

said stator assembly includes a bearing surface;

said rotor assembly includes at least one drag shoe assembly;

displacement means adapted to move said drag shoe assembly from a first position in which said drag shoe assembly is disengaged from said bearing surface to either (a) a second position in which said drag shoe assembly rests against and angularly engages said bearing surface and said chosen direction is clockwise or (b) a third position in which said drag shoe assembly rests against and angularly engages said bearing surface and said chosen direction is counter-clockwise whereby in either (a) said second position or (b) said third position pivotal motion of said rotor assembly in said chosen direction of rotation with respect to said stator assembly is accompanied by sliding engagement of said at least one drag shoe assembly and pivotal motion of said rotor assembly in an opposite direction of rotation with respect to said stator assembly is accompanied by jamming of said drag shoe assembly.

14. For the turnstile of claim 13, a method of reversing the chosen direction of rotation of said turnstile, commencing with said turnstile in either (a) said second position or (b) said third position, said method comprising:

moving said displacement means to position said drag shoe assembly in said first position;

choosing an opposite direction of rotation;

turning said turnstile in said opposite direction; and, while turning said turnstile, moving said displacement means to position said drag shoe assembly in the other of (a) said second position or (b) said third position.

15. For the turnstile of claim 13 also comprising a quick release means comprising a quick release wrench and a gripping means adapted to be engaged by said wrench; said displacement means comprising a threaded bolt working in opposition to a spring; said threaded bolt comprising a head, said head being provided with a through hole formed therein; said gripping means being said through hole; and said wrench comprising a cylindrical shaft adapted for entry through and engagement of said through hole of said threaded bolt, the method of claim 14, wherein said method comprises:

moving said displacement means by gripping said bolt with said quick release wrench and turning said bolt to position said drag shoe assembly in said first position;

choosing said opposite direction of rotation;

turning said turnstile in said opposite direction; and moving said displacement means to position said drag shoe assembly in the other of (a) said second position or (b) said third position by turning said bolt to said other position.

* * * * *